United States Patent [19]

Cowen

[11] 4,170,886

[45] Oct. 16, 1979

[54] NUMERICAL COMBINATION REPLACEMENT FOR CYLINDER LOCKS

[76] Inventor: Lloyd S. Cowen, 816 Leeds Dr., N. Bellmore, N.Y. 11710

[21] Appl. No.: 914,486

[22] Filed: Jun. 12, 1978

[51] Int. Cl.[2] ..... E05B 37/08

[52] U.S. Cl. ..... 70/302; 70/321; 70/431

[58] Field of Search ..... 70/133, 138, 218, 219, 70/302, 303 R, 309, 311, 321, 322, 431

[56] References Cited

U.S. PATENT DOCUMENTS

| | | | |
|---|---|---|---|
| 1,022,268 | 4/1912 | Schechter | 70/303 R |
| 3,099,150 | 7/1963 | Check | 70/133 |
| 4,064,718 | 12/1977 | Cowen | 70/302 |

*Primary Examiner*—Robert L. Wolfe
*Attorney, Agent, or Firm*—Charles E. Temko

[57] ABSTRACT

A replacement housing and plug adapted to substitute a key-operated housing, plug and tumblers in an existing tumbler lock without extensive modification of an existing installation in a door, thereby reducing the possibility of mechanical picking of the tumblers which are thereby eliminated. The combination tumblers are disposed for rotation about an axis corresponding to the axis of the substituted plug, and a resiliently urged locking bar is positioned above the tumblers to drop into tumbler engaging position when the proper combination has been obtained, thereby interconnecting a dial member with a lock opening means for transmitted motion from the former to the latter.

1 Claim, 4 Drawing Figures

NUMERICAL COMBINATION REPLACEMENT FOR CYLINDER LOCKS

BACKGROUND OF THE INVENTION

This invention relates generally to the field of conventional cylinder type door locks, and more particularly to an improved replacement housing of permutation type employing a plurality of combination tumblers adapted to substitute for an existing pin tumbler plug element within the substituted cylinder housing.

Pin tumbler constructions employ a key having notches along the shank portion thereof which correspond to the heights of cylinder plug pins in a given lock. When inserted into the plug through an exposed opening, the proper key aligns all of the parallel pin tumblers in the lock such that the parting planes of each tumbler are in concurrent relation with the surface of the plug permitting the plug to be turned to release a locking structure disposed there behind. If an incorrect key is inserted, a difference of as little as one sixty-fourth of an inch in any tumbler prevents the lock from turning. However, because of the presence of an opening in the exposed surface of the plug for the insertion of the key, the lock may be mechanically picked using a technique known as "torking" in which each tumbler is individually overcome in serial fashion by the insertion of an elongated picking tool.

Combination or mutation locks are well known in the lock art, and have been extensively used in padlocks and safe door constructions. While they are not totally immune to picking operations, considerably greater skills are necessary to overcome the combination tumblers which are not physically accessible to a potential lockpick. At the present state of the art, very little has been done in the way of providing a substitute permutation type construction of configuration adapting it to be placed in cylindrical openings present in existing doors, whereby the likelihood of picking is reduced.

Reference is made to U.S. Pat. No. 4,064,718 granted Dec. 27, 1977 to Lloyd G. Cowen, one of the applicants herein, which discloses a related structure, the present application disclosing an improved construction.

In the above mentioned patent, provision is made for replacing the cylinder plug which is rotatably mounted within the lock housing. While this structure is not without utility, the relatively small diameter of the plug which the device replaces necessitates the making of the parts on a very small scale, and the combination tumblers are of correspondingly small diameter. As a result, relatively few numerical combinations are available, and, because of the presence of a relatively large number of gears and two separate parallel shafts, the cost of manufacture is relatively high.

SUMMARY OF THE INVENTION

Briefly stated, the present invention contemplates the provision of an improved permutation construction, in which both the housing and the plug of the replaced pin tumbler lock are substituted. The combination tumblers are of a diameter corresponding to the substituted plug, and rotate about an axis which is laterally displaced from the principal axis of the housing. In the available space above the combination tumblers is a locking bar which is resiliently urged against the peripheries of the combination tumblers so that when the proper combination is obtained, and notches in the tumblers are aligned, the locking bar moves laterally with respect to its own axis to engage the aligned notches and permit the transfer of motion from the manually operated dial to a lock actuating member disposed inwardly thereof. When the door is to be relocked, the dial is merely rotated in an opposite direction resulting in the dislodging of the locking bar as soon as the lock operating means has released or otherwise caused the door latch to reengage. As the combination tumblers are of considerably larger diameter than those disclosed in the above mentioned patent, and may be many more in number, the total number of combinations is substantially greater, making the lock more difficult to be overcome by unauthorized persons. In addition, all gears have been eliminated, and only one driven shaft is necessary. As a result, the cost of fabrication is materially reduced, and during installation, it is not necessary to disassemble the existing lock housing. Rather, the entire housing is replaced and substituted by the replacement housing without any disassembly of the internal parts whatsoever.

BRIEF DESCRIPTION OF THE DRAWING

In the drawing, to which reference will be made in the specification, similar character reference have been employed to designated corresponding parts throughout several views.

DETAILED DESCRIPTION OF THE DISCLOSED EMBODIMENT

Figure 3:
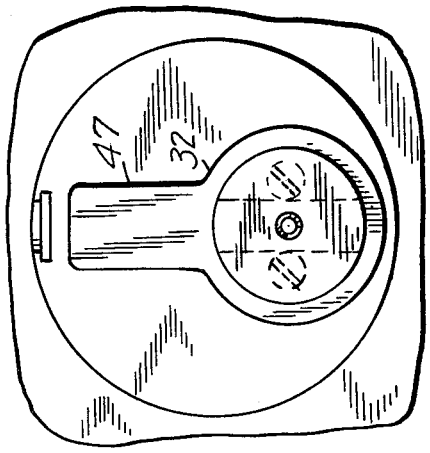
FIG. 3 is an end elevational view thereof.
Figure 2:
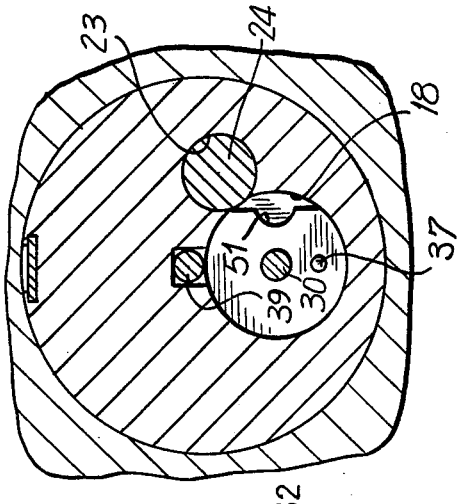
FIG. 2 is a transverse sectional view thereof, as seen from the plane 2—2 in FIG. 1.
Figure 1:
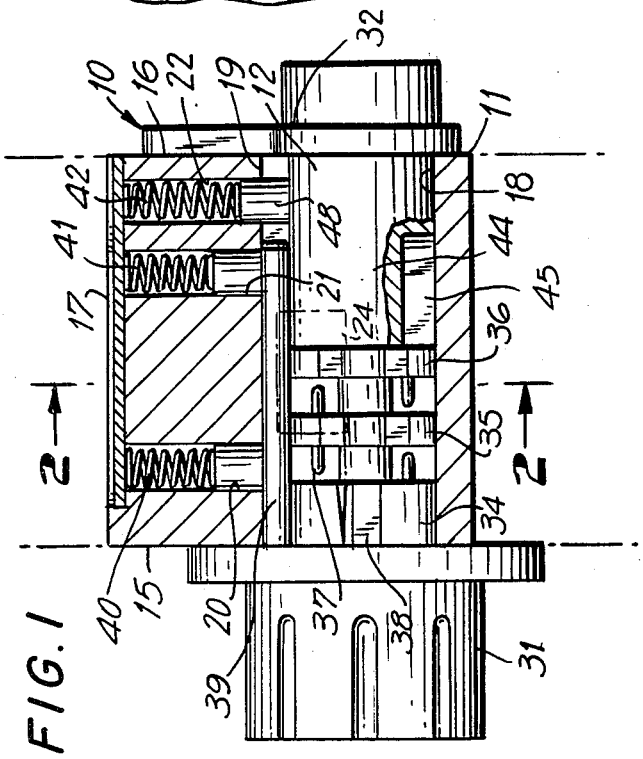
FIG. 1 is a fragmentary longitudinal sectional view of an embodiment of the invention.
Figure 4:
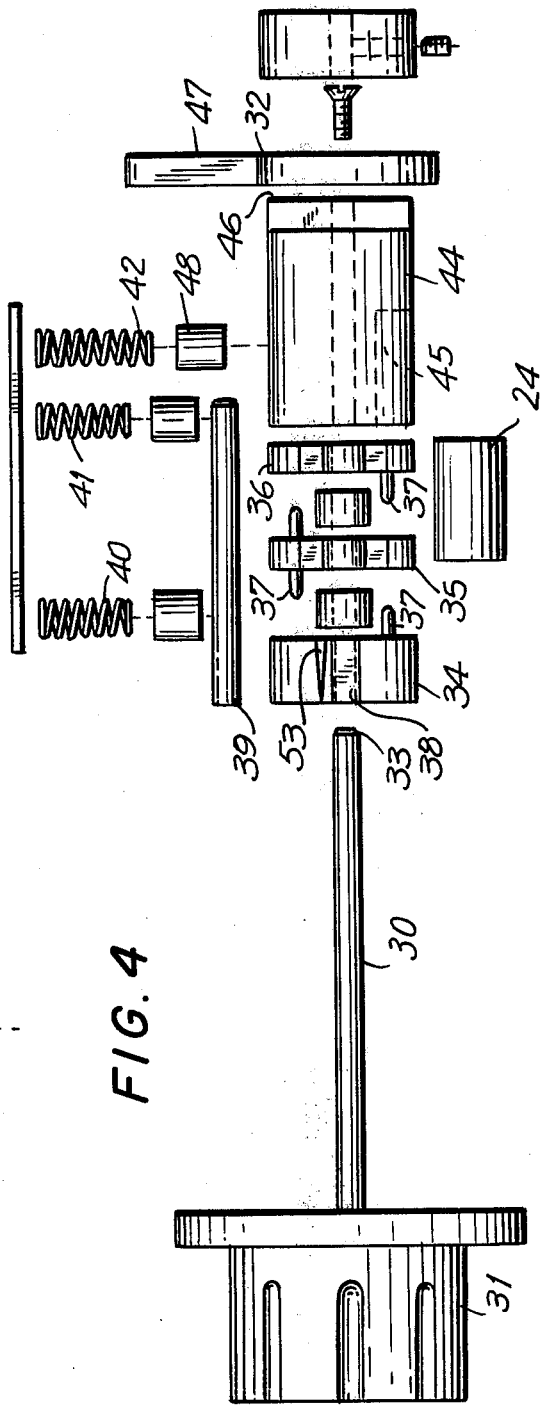
FIG. 4 is an exploded view in perspective of the structure shown in FIG. 1, with the housing element eliminated for purposes of clarity.

In accordance with the invention, the device generally indicated by reference character 10, comprises broadly: a cylindrical housing element 11 and a permutation plug element 12.

The housing element 11 is bounded by a forward surface 15, a rearward surface 16 and cylindrical surface 17, the diameter of which corresponds to that of the cylinder lock which it replaces. A through cylindrical bore 18 extends between the surface 15 and 16 in offset relation with respect to the principal axis of the housing, so that the plug element 12 will be aligned for rotation about an axis corresponding to that of the plug element in the replaced cylinder lock. Positioned above the bore 18 is an elongated locking bar channel 19 which communicates therewith.

Extending at right angles from the channel 19 are a plurality of spring enclosing channels 20, 21 and 22. A longitudinally extended channel 23 supports an elongated friction member 24, a portion of which extends into the bore 18.

The plug element 12 is capable of rotational movement relative to the housing 11, and includes a main shaft member 30, an outer end of which mounts an operating knob 31 which is dialed against an index (not shown) in well-known manner. A lock operating member 32 is disposed at an opposite end 33 of the shaft 30. Positioned medially on the shaft are first, second and third combination tumblers 34, 35 and 36, each including projecting pins 37 for the transmission of motion there between, and an alignable slot or notch 38 for the engagement of a locking bar 39 normally disposed within the channel 19. Springs 40 and 41 in the channels 20 and 21 bear against the bar 39, so that upon the attainment of an aligned condition, the bar merely drops into the aligned slots or notches permitting the transmission of motion directly from the knob 31 to the lock operating member 32.

The member 32, like the tumblers 34 and 36 has an outer diameter corresponding to that of the bore 18. The cylindrical portion 44 includes a corresponding elongated slot 45, and a rear surface 46 supports a radially extending member 47 which will normally be a part of the original structure of the lock being replaced. A detent member 48 urged by spring 42 in the channel 22 engages a corresponding detent 51 to maintain the lock operating member in a position corresponding to a locked condition until the same is dislodged during an opening operation.

The operation of the structure will be apparent from a consideration of the drawing. The operating knob is first rotated through several full revolutions in a first direction to assure that motion will be transmitted to the third tumbler 36, following which rotation is stopped when the alignable slot is positioned opposite the locking bar. Next the knob is rotated in an opposite direction passed 360 degrees and stopped when the second tumbler 35 is similarly aligned. Finally, the knob is rotated in the first direction less than 360 degrees to align the first tumbler 34. As this procedure is well known in the art, it need not be further considered at this point.

When all of the notches have been aligned, the locking bar will be urged into the through bore to prevent relative movement between any of the components of the plug element, and the next movement of the knob in the second mentioned direction will result in opening the lock.

When it is desired to relock the door, it is necessary only to close the door, and rotate the knob in the first direction wherein the bevelled surface 53 on the first tumbler 34 will start movement of the locking bar back into the channel 19, and a subsequent similar turning action for each of the other parts will complete this movement.

It may thus be seen that we have invented novel and highly useful improvements in replacement lock construction, in which with a minimum of alteration of existing lock openings in a door, a conventional pin type tumbler lock may be conveniently replaced with a permutation type lock. Because the permutation plug is disposed eccentrically with respect to the principal axis of the housing, the lock opening mechanism may be conveniently reconnected without substantial alteration, and the installation may have the same neat appearance as that of the original lock.

I wish it to be understood that I do not consider the invention limited to the precise details of structure shown and set forth in this specification, for obvious modifications will occur to those skilled in the art to which the invention pertains.

I claim:

1. As a new article of manufacture, a device for replacing a conventional door cylinder lock housing and plug comprising: a cylindrical housing having an outer diameter corresponding to that of the housing it replaces, said housing having a principal longitudinal axis, a through bore parallel to and laterally offset from said axis, and a longitudinally extending channel parallel to and communicating with said through bore; an elongated locking bar normally positioned within said channel, resilient means urging said bar from said channel into said through bore; a permutation plug element including a main shaft supported for rotation within said through bore, an operating knob fixed to a first outer end of said shaft, a plurality of combination tumblers mounted for relative rotation upon said shaft, each tumbler having a peripheral notch therein and pins projecting parallel to said shaft for the transmission of motion from tumbler to tumbler; a lock operating member, one portion of which is mounted upon said shaft and disposed within said through bore, and having a corresponding peripheral notch disposed at an inner end of said through bore, said lock operating member including a portion on an inner end thereof for communicating with an existing latch; whereby, upon the dialing of a correct combination resulting in alignment of the notches in said tumblers and said lock operating member, said locking bar is urged into engagement with said notches to permit the transmission of movement from said knob to said lock operating member for the operation of said existing latch.

* * * * *